US009382628B2

(12) United States Patent
Bongartz et al.

(10) Patent No.: US 9,382,628 B2
(45) Date of Patent: Jul. 5, 2016

(54) MULTI-STEP METHOD FOR ELECTRODEPOSITION

(71) Applicant: Henkel AG & Co. KGaA, Duesseldorf (DE)

(72) Inventors: Nils Bongartz, Haan (DE); Kirsten Agnes Lill, Köln (DE); Ralf Posner, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/968,977

(22) Filed: Dec. 15, 2015

(65) Prior Publication Data

US 2016/0102405 A1 Apr. 14, 2016

Related U.S. Application Data

(63) Continuation of application No. PCT/EP2014/060063, filed on May 16, 2014.

(30) Foreign Application Priority Data

Jun. 20, 2013 (EP) ..... 13173055

(51) Int. Cl.
*C23C 22/34* (2006.01)
*C23C 22/83* (2006.01)
*C25D 13/20* (2006.01)

(52) U.S. Cl.
CPC ..... *C23C 22/34* (2013.01); *C23C 22/83* (2013.01); *C25D 13/20* (2013.01)

(58) Field of Classification Search
CPC ..... C23C 22/34; C23C 22/83; C25D 13/20
See application file for complete search history.

(56) References Cited

U.S. PATENT DOCUMENTS

| | | | |
|---|---|---|---|
| 2008/0302448 | A1 | 12/2008 | Frey et al. |
| 2012/0183806 | A1 | 7/2012 | McMillen et al. |
| 2014/0255706 | A1 | 9/2014 | Kolberg et al. |

FOREIGN PATENT DOCUMENTS

| | | | |
|---|---|---|---|
| DE | 4133102 | A1 | 4/1993 |
| DE | 102005015576 | A1 | 10/2006 |
| DE | 102012219296 | A1 | 4/2013 |
| EP | 1455002 | A1 | 9/2004 |
| WO | 2007065645 | A1 | 6/2007 |

OTHER PUBLICATIONS

International Search Report for International Application No. PCT/EP2014/060063 dated Aug. 20, 2014.

*Primary Examiner* — Kishor Mayekar
(74) *Attorney, Agent, or Firm* — Mary K. Cameron

(57) ABSTRACT

The subject matter of the present invention is a multi-step method for the anti-corrosive coating of metal components, in which a reaction rinse is used after a conversion treatment but before electrodeposition is carried out on the component. The conversion treatment includes first the deposition of a thin inorganic layer containing the elements Zr and/or Ti. The metal component is then treated with a reaction rinse containing a surface-active substance and is subsequently subjected to electrodeposition.

20 Claims, No Drawings

MULTI-STEP METHOD FOR ELECTRODEPOSITION

The subject matter of the present invention is a multi-step method for anticorrosion coating of metal components in which a reaction rinse is used after a conversion treatment, before an electrodeposition is performed on the component. The conversion treatment includes, first, the deposition of a thin inorganic layer containing the elements Zr and/or Ti. The metal component is then aftertreated with a reaction rinse containing a surface-active substance and then electro-dip coating is performed.

The anticorrosion coating of metal components by a multi-step method consisting of conversion treatment and subsequent electro-dip coating is a method that has been practiced for several decades in the meantime. From an economic standpoint and based on ecological considerations, the automotive industry has been attempting to replace the conversion treatment by zinc phosphating, which is well established technologically, with a pretreatment that has the most equivalent possible effect while saving on resources. In contrast with zinc phosphating, alternative concepts for conversion treatment often lead to amorphous coatings with layer thicknesses in the nanometer range in order to do justice to a pretreatment method that has lower consumption of materials.

WO 07/065645 discloses such a method that saves on resources and is used for anticorrosion coating of metallic substrates, such as steel and galvanized steel, including the method steps of conversion treatment and subsequent dip coating, wherein a rinse step and/or drying step is optionally performed between the conversion treatment and the electro-dip coating. According to this teaching, a "wet-on-wet" method, in which there is no drying step and thus the metal substrates provided with a wet film can be electro-dip coated immediately, is preferred. The conversion treatment is performed essentially by using chromium-free acidic aqueous compositions based on fluorine complexes of the elements Zr and/or Ti.

Then conversion layers such as those obtained according to WO 07/065645 naturally tend to have a lower electrical layer resistance than the crystalline coatings of zinc phosphating, which yields layer thicknesses of only a few micrometers. However, a high electrical layer resistance is advantageous for the electro-dip coating used in the established methods of anticorrosion coating of vehicle bodies because a high electrical resistance significantly improves the "creep" of the electro-dip coating into cavity structures in the metal component to be coated. This typical coating behavior in electro-dip coating is known as "throwing power behavior," because it describes the throwing power of the electro-dip coating into regions of the component where the electrical field line density is low. The automotive industry is trying to improve the throwing power behavior, so that either a deeper penetration of the dip coating into electrically shielded regions of the vehicle body is made possible at the same dip coating thickness in the exterior region of a vehicle body or a lower electro-dip coating thickness is required in the exterior area of the body at the same throwing power. There is thus a need for improving the method described above for anticorrosion coating to the extent that a throwing power behavior that is almost equivalent is achieved by electro-dip coating without having to rely on conversion treatments of the phosphating type.

EP 1 455 002 A1 discloses in a related context a conversion treatment by means of a chromium-free acidic aqueous composition containing fluoro complexes of Zr and/or Ti, wherein, after the conversion treatment and before the electro-dip coating, different aftertreatment steps are proposed in order to reduce the amount of water-soluble fluorides in the conversion layer and thereby improve the corrosion protection after successful electro-dip coating. Among other things, an intermediate rinse with an alkaline aqueous solution is proposed as an effective aftertreatment step. However, the focus of this prior art is on improving the corrosive undermigration of the coated metal component and lies less on finding a balance between the conversion treatment by means of a chromium-free acidic aqueous composition containing fluoro complexes of the elements Zr and/or Ti with the requirements of an electro-dip coating that has been improved or also made more conservative of resources.

According to WO 07/065645, an intermediate rinse may also take place before electro-dip coating and after the conversion treatment, wherein aqueous solutions containing water-soluble compounds of the elements Co, Ni, Sn, Cu, Ti and Zr or water-soluble and/or water-dispersible organic polymers may be used for this purpose.

In the present case the object in light of this prior art is to modify the known process sequence of anticorrosion pretreatment and subsequent electro-dip coating to the extent that, on the one hand, savings are achieved with regard to the coating material in the electro-dip coating method and, on the other hand, components having complex geometries can be satisfactorily electro-dip coated.

This object is achieved by a multi-step method for anticorrosion coating of the surfaces of a metal component, wherein the surface of the metal component is subjected to a conversion treatment by bringing it in contact with an acidic aqueous composition containing water-soluble compounds of the elements zirconium and/or titanium, as a result of which a layer coating of at least 10 $mg/m^2$ zirconium and/or titanium is produced directly on the surface of the metal component, wherein this conversion treatment is performed with or without an intermediate rinse step and/or drying step, wherein the reaction rinse takes place by bringing the conversion-treated surface of the metal component in contact with an aqueous composition containing at least one surface-active substance and then performing electro-dip coating on the surface of the metal component treated in this way with or without an intermediate rinse step and/or drying step.

A "conversion treatment" in the sense of the present invention is any wet chemical pretreatment of a metal surface, as a result of which metal elements from the wet chemical pretreatment become analytically measureable components of such a surface coating that does not constituted an essentially natural oxide layer of the conversion-treated metal.

"Surface-active substances" in the sense of the present invention are organic compounds made up of a hydrophilic molecular constituent and a lipophilic molecular constituent or of one lipophilic molecular constituent and at least one hydrophilic molecular constituent, wherein the molecular weight of the surface-active substance does not exceed 2000 g/mol.

"Electro-dip coating" in the sense of the present invention is any deposition of an organic coating from an aqueous phase containing the coating, this deposition being induced by applying an external voltage source to the metal component.

A "rinse step" in the sense of the present invention denotes a process, which is intended solely to remove as extensively as possible active ingredients remaining from an immediately preceding wet chemical treatment step, these components being present in dissolved form in a wet film adhering to the component, without replacing the active ingredients to be removed by others. Active ingredients in this context are constituents containing a liquid phase and producing an analytically detectable coverage of the metal surface of the component with elementary constituents of the active ingredients.

A "drying step" in the sense of the present invention denotes a process in which the surfaces of the metal component having a wet film are to be dried with the aid of technical measures.

The applied layer of zirconium and/or titanium can be determined immediately following the conversion treatment by means of x-ray fluorescence analysis methods (RFA) after rinsing with deionized water ($\kappa<1\ \mu Scm^{-1}$) and then drying the component.

In the method according to the invention, the metal components, which have had an anticorrosion pretreatment and are then aftertreated by a reaction rinse, exhibit a lower layer thickness of the immersion coating and/or improved throwing power behavior at the same thickness of the immersion dip coating layer. Therefore, a mode of operation in electro-dip coating that is comparatively conservative in use of materials is ensured, and the electro-dip coating of complex metal components having cavity-type structures is improved.

In the reaction rinse the amount of surface-active substances is preferably at least 20 ppm, especially preferably at least 50 ppm. If the actual amounts are lower than these preferred minimum quantities of surface-active substances, there is a significant decline in the throwing power with otherwise identical parameters in the electro-dip coating, which is no longer acceptable for certain applications and components having a complex geometry. Above 1% by weight of surface-active substances, a further improvement in throwing power is not generally observed, so that, for reasons of economy, the reaction rinse of the method according to the invention preferably contains no more than 1% by weight surface-active substances. The abbreviation "ppm" stands for parts per million and, within the context of the present invention, refers to the mass of the respective composition, so that 1 ppm corresponds to an amount of 1 mg of the respective substance per kilogram of the respective composition.

The surface-active substances in the reaction rinse of the method according to the invention can be selected from ionic surfactants, cationic surfactants, zwitterionic surfactants and nonionics, but the use of nonionics in the reaction rinse is preferred because of their good compatibility with the constituents of the bath in electro-dip coating, among other things. Compatibility here is understood to refer to the lack of precipitates in the electro-dip coating bath. This compatibility of the surface-active substances with bath constituents in electro-dip coating is to be taken into account because it is impossible to completely prevent some transfer of constituents from the reaction rinse into the electro-dip coating bath, in particular in the case of the anticorrosion coating.

In addition, it has been found that nonionics, as constituents of the reaction bath, have a comparatively greater positive influence on the throwing power behavior of the immersion dip coating. In this context, nonionic having an HLB (hydrophilic-lipophilic balance) value of at least 8, especially preferably at least 10, in particular preferably at least 12, but especially preferably no more than 18, in particular preferably no more than 16, are preferred in this context in general.

The HLB value is used for quantitative classification of nonionics in accordance with their internal molecular structure, the nonionics being divided into a lipophilic group and a hydrophilic group. The HLB value according to the present invention is calculated using the following equation and can assume values from 0 to 20 on an arbitrary scale:

$$HLB=20\cdot(1-M_l/M)$$

where $M_l$: molecular weight of the lipophilic group of the nonionic M: molecular weight of the nonionic With regard to materials, such nonionics are preferred in the reaction rinse of the method according to the invention to further improve the throwing power of the dip coating. They are selected from alkoxylated alkyl alcohols, alkoxylated fatty amines and/or alkyl polyglycosides, especially preferably from alkoxylated alkyl alcohols and/or alkoxylated fatty amines, in particular preferably from alkoxylated alkyl alcohols. The alkoxylated alkyl alcohols and/or alkoxylated fatty amines are preferably end group capped, especially preferably with an alkyl group, which in turn preferably contains no more than 8 carbon atoms, especially preferably no more than 4 carbon atoms.

Especially preferred are those alkoxylated alkyl alcohols and/or alkoxylated fatty amines as nonionics in the reaction rinse of the method according to the invention, which are present in ethoxylated and/or propoxylated form, wherein the total number of alkylene oxide units is preferably no greater than 20, especially preferably no greater than 16, but especially preferably at least 4, in particular preferably at least 8.

With regard to the lipophilic component of the nonionics mentioned above, the preferred nonionics in the reaction rinse of the method according to the invention are the alkoxylated alkyl alcohols and/or alkoxylated fatty amines, in which the alkyl group is saturated and preferably unbranched, and the number of carbon atoms in the alkyl group is preferably no less than 6, especially preferably no less than 10, but preferably no greater than 24, especially preferably no greater than 20.

On the whole, it is found that longer-chain nonionics are preferred for improving the throwing power behavior by means of the reaction rinse, so that in another preferred embodiment of the method according to the invention, alkoxylated alkyl alcohols and/or alkoxylated fatty amines, in particular the alkoxylated alkyl alcohols whose lipophilic alkyl group has at least 10 carbon atoms, especially preferably at least 12 carbon atoms, are preferred, where the longest carbon chain in the alkyl group consists of at least 8 carbon atoms, and an HLB value in the range of 12 to 16 is achieved.

Preferred representatives of the alkoxylated alkyl alcohols are preferably selected from the following in the method according to the invention:

- four- to eight-fold ethoxylated or propoxylated $C_6$-$C_{12}$ fatty alcohols,
- eight- to sixteen-fold ethoxylated $C_{12}$-$C_{18}$ fatty alcohols,
- six- to fourteen-fold propoxylated $C_{12}$-$C_{18}$ fatty alcohols,
- four- to eight-fold ethoxylated and propoxylated $C_{12}$-$C_{18}$ fatty alcohols, which in turn may be present in methyl, butyl or benzyl end group-capped form.

For the reaction rinses of the method according to the invention, the pH is preferably no less than 4, especially preferably no less than 6, to minimize the pickling attack on the coating produced in the conversion treatment as much as possible by means of an acidic reaction rinse. Conversely, the reaction rinses preferably should not have a pH higher than 12, especially no higher than 10. For the aforementioned reaction rinses containing nonionics in a preferred embodiment of the method according to the invention, the pH is to be adjusted to neutral (pH 7) to alkaline, and again the pH should preferably be no higher than 12, especially preferably no higher than 11, in particular preferably no higher than 10, but preferably amounts to at least 7, especially preferably at least 8. In the presence of nonionics, establishing an alkaline pH results in a definite improvement in the throwing power in the subsequent electro-dip coating, in particular when there is no rinse step, especially preferably neither a rinse step nor a drying step between the conversion treatment and the reaction rinse. The pH of the reaction rinse is preferably adjusted by means of a buffer system so that input of constituents of the acidic aqueous composition from the conversion treatment into the after-rinse does not lead to a shift in the pH outside of the optimum range. In a particular preferred embodiment of the method according to the invention, therefore an additional rinse step after the conversion treatment and before the reaction rinse may be omitted. Use of a buffer system also facilitates control of the bath because any subsequent dosing of substances to stabilize the pH need only be moderate and occasional. In a preferred embodiment of the method according to the invention, the reaction rinse contains the buffer system at least in an amount, such that when 1 eq of acid is added, the pH does not change by more than 0.5 unit, preferably no more than 1.0 unit, but preferably not exceeding amounts of buffer for which the reaction rinse assumes an electric conductivity of more than 1.0 $mScm^{-1}$, preferably more than 0.5 $mScm^{-1}$. A preferred buffer system is a carbonate-bicarbonate buffer system (for example, $Na_2CO_3$/$NaHCO_3$).

Within the context of the present invention, the "pH value" denotes the negative common logarithm from the activity of the hydronium ions at 25° C.

It has been found that the positive influence of the reaction rinse on the throwing power of the immersion coating is diminished by the additional presence of active ingredients that form a layer and occasionally it fails to occur at all. This is true in particular of such active ingredients, which are capable of forming thin amorphous phosphate layers. In a preferred embodiment of the method according to the invention, the aqueous composition of the reaction rinse therefore contains less than 1 g/kg, especially preferably less than 0.1 g/kg, in particular preferably less than 0.01 g/kg of phosphates dissolved in water, calculated as $PO_4$.

The layer-forming active ingredients, which have a negative effect on the throwing power, also include water-soluble compounds of certain metal elements, which usually bring about a conversion of the metal surface. Accordingly, in another preferred embodiment of the method according to the invention, it is preferable for the aqueous composition of the reaction rinse to contain less than 20 ppm, especially preferably less than 10 ppm, in particular preferably less than 1 ppm water-soluble compounds of elements of secondary groups IIIB, IVB, VIB and/or the element vanadium, based on the respective element, wherein preferably there is a total of less than 20 ppm of these water-soluble compounds, based on the aforementioned elements. The situation is similar for the presence of silanes, which are usually present in the reaction rinse of the method according to the invention in an amount of less than 0.005 g/L, especially preferably less than 0.002 g/L, in particular preferably less than 0.001 g/L, calculated on the basis of the corresponding silanols.

"Silanes" in the context of this invention include silanes, silanols, siloxanes, polysiloxanes and their reaction products and/or derivatives. Reaction products include in particular condensation products and hydrolysis products in the aqueous medium.

Another disadvantage for the throwing power behavior of the immersion coating in the method according to the invention may be the presence of such layer-forming active ingredients in the reaction rinse that cause deposition of a metallic phase on contact with the metal component. Accordingly, in another preferred embodiment of the method according to the invention, it is preferable that the aqueous composition of the reaction rinse contains less than 50 ppm, preferably less than 10 ppm, especially preferably less than 5 ppm water-soluble compounds of the elements Co, Ni, Cu and/or Sn, based on the respective element, wherein there is preferably a total of less than 50 ppm of these water-soluble compounds, based on the aforementioned elements.

The conversion treatment preceding the reaction rinse takes place in a method that is preferred according to the invention with acidic aqueous compositions containing fluoric acids of the elements zirconium and/or titanium as well as their salts and hydrolysis products. Hydrolysis products include, for example, compounds in which fluoride ions on the central atom are substituted in part by hydroxide ions.

It has surprisingly been found that the reaction rinse for such methods according to the invention, in which a phosphate layer is created in the conversion treatment, produce a much lower effect with regard to the improvement in throwing power in the subsequent electro-dip coating. According to the invention, it is therefore preferable that the acidic aqueous composition for the conversion treatment does not contain any phosphate layer with a layer application of at least 0.2 $g/m^2$, based on $PO_4$, on the metal component. To ensure this, the acidic aqueous composition for the conversion treatment should preferably contain a total of less than 1 g/kg, especially preferably a total of less than 0.1 g/kg of phosphates dissolved in water, calculated as $PO_4$.

It has also been found that the presence of copper ions in the acidic aqueous composition of the conversion treatment, which are usually added in such small amounts to the conversion bath for accelerating the formation of the conversion layer, based on the elements zirconium and/or titanium, may have a negative influence on the efficacy of the method according to the invention when applied by a spraying method. It is therefore preferable for the acidic aqueous composition for the conversion treatment in such methods according to the invention, in which the conversion treatment is performed by spraying, to contain a total of less than 50 ppm, especially preferably less than 10 ppm, in particular preferably less than 1 ppm of copper ions dissolved in water. On the whole, it is true of the method according to the invention that the molar ratio of the total amount of water-soluble compounds of zirconium and/or titanium, based on the respective elements zirconium and titanium, to the total amount of water-soluble compounds of the elements Co, Ni, Cu and/or Sn, based on the respective elements Co, Ni, Cu and/or Sn in the conversion bath, is preferably no less than 0.6, especially preferably no less than 1.0.

In addition, it has already been found that this presence in the reaction rinse may be a disadvantage for the method according to the invention. Accordingly, such methods in which the addition of silanes to the reaction rinse is largely suppressed are preferred. This may take place in particular by the fact that the acidic composition in the conversion treatment is not a silane-based composition. In methods that are preferred according to the invention, the acidic composition in the conversion treatment contains a total of less than 0.005 g/L, especially preferably less than 0.002 g/L, in particular preferably less than 0.001 g/L of silanes, calculated on the basis of the corresponding silanols.

The type of application of the acidic aqueous composition in the conversion treatment as well as that of the reaction rinse can be selected freely among the traditional application methods. Thus, for example, the aqueous compositions of the method according to the invention may be brought in contact with the metal component by spraying methods as well as immersion methods.

In terms of the standpoint of the process engineering, a rinse step and/or drying step may be inserted between the reaction rinse and the subsequent electro-dip coating. The advantage of the method according to the invention is that the nonionics that are present in the reaction rinse in a preferred variant according to the invention do not have a negative influence on the electro-dip coating, so there is no need for an intermediate rinse step to remove the surface-active substances in the wet film adhering to the component prior to the electro-dip coating. In a preferred embodiment of the method according to the invention, the metal component may therefore be treated by electro-dip coating after the reaction rinse and without an intermediate rinse step.

Furthermore, in an method according to the invention, it has been found that drying of the component immediately after the reaction rinse or drying of the component immediately after a rinse step performed after the reaction rinse are not necessary for an improved throwing power behavior in the following electro-dip coating, so that the present method may be carried out completely "wet-on-wet"—i.e., without an arbitrary drying step—with regard to its individual steps.

Accordingly, it is preferred according to the invention if no drying step in which the drying takes place above a temperature of 40° C. is performed at all after the reaction rinse and before the electro-dip coating, and preferably there is no drying step at all.

The metal component with an anticorrosion coating in the method according to the invention is preferably selected from aluminum, zinc, iron, steel and/or galvanized steel. The method according to the invention is especially suitable for improving the throwing power of an immersion coating on surfaces made of steel and/or galvanized steel.

Exemplary Embodiments

All the experiments were conducted with cold rolled steel (CRS). The following basic process was employed in all the examples described below:

1) Alkaline cleaning:

The bath is filled with process water to prepare the alkaline cleaner, and 3% Ridoline® 1574 and 0.3% Ridosol® 1270 (each from Henkel AG & Co. KGaA) are added and the pH is adjusted to 11 by gradual addition of a phosphoric acid solution.

Spray pressure: 1 bar
Temperature: 50-60° C.
Treatment time: 120 seconds

2) Deionized water rinse ($\kappa<1\ \mu Scm^{-1}$):
Spray pressure: 1 bar
Temperature: room temperature ° C.
Treatment time: 30-60 seconds 3) Conversion treatment 4) Reaction rinse 5) Deionized water rinse ($\kappa<1\ \mu Scm^{-1}$)
Spray pressure: 1 bar
Temperature: room temperature ° C.
Treatment time: 30 to 60 seconds 6) Cathodic dip coating (CathoPrime®, BASF Coatings AG):

The batch was prepared by adding 690 g pigment paste GV81-0001 and 1760 g binder GY80-0640 (each from BASF Coatings AG) to 2573 g deionized water while stirring. Deposition took place at 30° C. bath temperature potentiostatically for a total of 105 seconds at a voltage of 160 V. This deposition voltage was adjusted by means of a corresponding potential ramp within 15 seconds. After curing of the immersion coating for 25 minutes at 180° C., the thicknesses of each of the coating layers was determined by means of a layer thickness measuring device (DUALSCOPE® FMP40, Helmut Fischer GmbH).

To show the effect of the reaction rinse on the thickness of the immersion coating and on the throwing power, two pairs of metal plates were prepared, with each pair of reference plates passing only through treatment steps 1-3, 5 and 6. The changes with regard to the thickness of the immersion coating and the throwing power are based on the corresponding values of the reference pair of plates.

To determine the throwing power of the electro-dip coating, two plates were combined with the help of a plastic frame and adhesive tape to form an apparatus, wherein the distance between the internal metal plate surfaces was 4 mm. The electro-dip coating was able to penetrate into the internal volume surrounded by the plates and the plastic spacer only through a lower opening between the two inside surfaces of the plates. This apparatus was introduced into the agitated electro-dip coating bath mentioned above and was connected as the cathode. Opposite the exterior plate surfaces, one stainless steel anode was arranged in parallel at a distance of 10 cm, where the area ratio of the cathode to the anode was 5:1.

EXAMPLE B1

The conversion bath contained 270 ppm $H_2ZrF_6$, 60 ppm $ZrO(NO_3)_2$ and 300 ppm $HNO_3$. The pH was adjusted to a pH of 4.5 by adding aqueous ammoniacal solution. The conversion treatment was performed at a bath temperature of 40° C. for 60 seconds by a spray method at a pressure of 1 bar.

The reaction rinse was performed using a solution of 750 ppm 2,4,7,9-tetramethyl-5-decyne-4,7-diol in deionized water for 60 seconds at 20° C. by immersion.

EXAMPLE B2

Conversion treatment as described in Example 1.

The reaction rinse was performed using 200 ppm of butyl end group-capped 4- to 5-fold ethoxylated octanol ($C_8$, 4-5 EO, butyl; HLB value 14) in deionized water for 60 seconds at 20° C. by immersion.

EXAMPLE B3

Conversion treatment as described in Example 1, but at a bath temperature of 20° C.

The reaction rinse was performed using a solution of 20 ppm butyl end group-capped 10-fold ethoxylated $C_{12}$-$C_{18}$ fatty alcohols ($C_{12}$-$C_{18}$, 10 EO, butyl; HLB value 13.3-15) in deionized water for 60 seconds at 20° C. by a spray method at a spray pressure of 1 bar.

EXAMPLE B4

Conversion treatment as described in Example 1, but at a bath temperature of 20° C.

The reaction rinse was performed for 60 seconds at 20° C. using the spray method with a spray pressure of 1 bar with a solution of 100 ppm butyl end group-capped 10-fold ethoxylated $C_{12}$-$C_{18}$ fatty alcohols ($C_{12}$-$C_{18}$, 10 EO, butyl; HLB value 13.3-15) and 5% by weight of a buffer system consisting of 0.2 mol/L $Na_2CO_3$ and 0.2 mol/L $NaHCO_3$ in deionized water (pH 9.7).

EXAMPLE B5

Conversion treatment as described in Example 1, but at a bath temperature of 20° C.

The reaction rinse was performed for 60 seconds at 20° C. in the spray method with a spray pressure of 1 bar using a solution of 100 ppm butyl end group-capped 10-fold ethoxylated $C_{12}$-$C_{18}$ fatty alcohols ($C_{12}$-$C_{18}$, 10 EO, butyl; HLB value 13.3-15) at a pH of 7.8.

EXAMPLE B6

The conversion bath contained 340 ppm $H_2ZrF_6$, 15 ppm $Cu(NO_3)_2$ and 4 ppm HF. The pH was adjusted to pH 4.0 by adding aqueous ammonia solution. The conversion treatment was performed at a bath temperature of 20° C. for 120 seconds in the immersion method.

The reaction rinse was performed with a solution of 1000 ppm butyl end group-capped 10-fold ethoxylated $C_{12}$-$C_{18}$ fatty alcohols ($C_{12}$-$C_{18}$, 10 EQ butyl; HLB value 13.3-15) in deionized water for 120 seconds at 20° C. by immersion.

EXAMPLE B7

Conversion treatment as described in Example 1, but at a bath temperature of 20° C.

The reaction rinse was performed using a solution of 67 ppm butyl end group-capped 10-fold ethoxylated $C_{12}$-$C_{18}$ fatty alcohols ($C_{12}$-$C_{18}$, 10 EO, butyl; HLB value 13.3-15) and 27 ppm $H_2ZrF_6$ in deionized water for 60 seconds at 20° C. in the spray method with a spray pressure of 1 bar.

COMPARATIVE EXAMPLE VB1

To prepare an iron phosphating solution, a bath was filled with deionized water, 2% by weight Duridine 7760 (Henkel AG & Co. KGaA) was added, the pH was adjusted slowly to pH 4.5 by adding sodium hydroxide solution. The plate was then sprayed with the iron phosphating solution from the bath for 110 seconds at a temperature of 50° C. and a spray pressure of 1 bar. The iron phosphate weight of the layer was 0.5 g/m$^2$ determined as PO4.

The reaction rinse was performed using a solution of 1000 ppm butyl end group-capped 10-fold ethoxylated $C_{12}$-$C_{18}$ fatty alcohols ($C_{12}$-$C_{18}$, 10 EO, butyl; HLB value 13.3-15) in deionized water for 60 seconds at 20° C. by immersion.

Table 1 below summarizes the values for the electro-dip coating thickness and the throwing power for the exemplary embodiments described above.

For each of Examples B1-B6 according to the invention, it is found that the thickness of the immersion dip coating is significantly reduced and at the same time improved throwing power is achieved (Table 1). Thus, the object of the present invention, which consists of achieving, on the one hand, savings with regard to the coating material in electro-dip coating and, on the other hand, being able to satisfactorily perform electro-dip coating on components having more complex geometries has been fully achieved. Furthermore, it is clear that the geminal nonionic according to Example B1 is slightly inferior in comparison with the linear amphiphilics of Examples B2-B6 with regard to the improvement in throwing power and the desired reduction in thickness of the electro-dip coating. A comparison of Examples B2 and B4 illustrates that the longer-chain end group-capped ethoxylated fatty alcohol (B4) yields the best results and in particular surprisingly greatly improves the throwing power behavior. The effect of the nonionics is also strictly selective for the preceding conversion treatment, as indicated by the Comparative Example VB1, in which the reaction rinse on an iron phosphate metal plate surface does not result in any improvement with regard to throwing power or thickness of the immersion coating. The composition of the reaction rinse, which goes beyond the nonionic as an active ingredient, is significant for the success of the method according to the invention. Example B7 thus shows that the additional presence of active ingredients from the conversion treatment step is a disadvantage and even a definite exacerbation in the throwing power behavior and with regard to the thickness of the electro-dip coating occurs at higher concentrations of these active ingredients (here: H2ZrF6). Therefore, in this context, it is also advantageous that the reaction rinse has an alkaline buffer as in Example B4, so that in an ongoing coating installation, transfer of conversion bath constituents into the reaction rinse by scooping components there leads only to precipitation of the compounds of the elements Zr and/or Ti and does not result in an inferior performance. In addition, in alkaline-buffered reaction rinses in comparison with neutral to slightly alkaline reaction rinses, an improvement in the throwing power of the coating can be observed, as shown by the comparison of Examples B4 and B5.

TABLE 1

| | Surfactant | Amount, ppm | Δ Coating thickness[1], μm | Δ Throwing power[2], cm |
|---|---|---|---|---|
| B1 | 2,4,7,9-Tetramethyl-5-decyne- | 750 | −2.6 | +0.5 |
| B2 | 4,7-diol | 200 | −3.4 | +0.7 |
| B3 | $C_8$, 4-5 EO, butyl | 20 | −2.0 | +1.0 |
| B4 | $C_{12}$-$C_{18}$, 10 EO, butyl | 100 | −5.0 | +2.5 |
| B5 | $C_{12}$-$C_{18}$, 10 EO, butyl | 100 | −3.0 | +0.5 |
| B6 | $C_{12}$-$C_{18}$, 10 EO, butyl | 1000 | −4.0 | +2.5 |
| B7 | $C_{12}$-$C_{18}$, 10 EO, butyl | 67 | +2.0 | −0.4 |
| VB1 | $C_{12}$-$C_{18}$, 10 EO, butyl | 1000 | 0.0 | 0.0 |
| | $C_{12}$-$C_{18}$, 10 EO, butyl | | | |

[1]The absolute values were measured on the outsides of the pairs of metal plates facing the anode (each averaged over five layer thickness measurements)
[2]The respective absolute value corresponds to the longest visible extent of the immersion coating on the insides of the sheet metal pair

The invention claimed is:

1. A method of anticorrosion coating of surfaces of a metal component, comprising:

a) subjecting a surface of a metal component to a conversion treatment by contacting the surfaces of the metal component with an acidic aqueous composition containing water-soluble compounds of the elements zirconium and/or titanium, thereby forming a conversion-treated surface of the metal component comprising a zirconium and/or titanium layer density of at least 10 mg/m$^2$ created directly on the surface of the metal component;

b) performing a reaction rinse following the conversion treatment, with or without an intermediate rinsing and/or drying step, by contacting the conversion-treated surface of the metal component with an aqueous composition, having a pH no lower than 8 and no higher than 10, and comprising at least one surface-active substance comprising at least one nonionic surfactant selected from alkoxylated alkyl alcohols, said at least one surface-active substance optionally further comprising at least one alkoxylated fatty amine; and c) following the reaction rinse of b), with or without an intermediate rinsing and/or drying step, treating the conversion-treated surface of the metal component by electro-dip coating.

2. The method according to claim 1, wherein the nonionic surfactants have an HLB value of at least 8, but no more than 18.

3. The method according to claim 1, wherein the alkoxylated alkyl alcohols are end group capped with an alkyl group.

4. The method according to claim 1, wherein the alkoxylated alkyl alcohols are end group capped with an alkyl group containing no more than 8 carbon atoms.

5. The method according to claim 1, wherein the at least one alkoxylated fatty amine is present as an end group capped alkoxylated fatty amine.

6. The method according to claim 5, wherein the at least one alkoxylated fatty amine is end group capped with an alkyl group containing no more than 8 carbon atoms.

7. The method according to claim 1, wherein the alkoxylated alkyl alcohols or the alkoxylated alkyl alcohols and alkoxylated fatty amines are present in ethoxylated and/or propoxylated forms, having a number of alkylene oxide units as a whole which is no greater than 20, but at least 4.

8. The method according to claim 1, wherein the alkoxylated alkyl alcohol or the alkoxylated alkyl alcohol and the alkoxylated fatty amine have saturated $C_6$-$C_{24}$ alkyl groups.

9. The method according to claim 1, wherein the alkoxylated alkyl alcohol or the alkoxylated alkyl alcohol and the alkoxylated fatty amine have unbranched, saturated $C_{10}$-$C_{20}$ alkyl groups.

10. The method according to claim 1, wherein an amount of the surface-active substances in the reaction rinse is more than 20 ppm, but no more than 1% by weight.

11. The method according to claim 1, wherein the aqueous composition of the step b) reaction rinse contains less than 1 g/kg of phosphates dissolved in water, calculated as $PO_4$.

12. The method according to claim 1, wherein the aqueous composition of the step b) reaction rinse contains less than 20 ppm of water-soluble compounds of elements of transition groups IIIB, IVB, VIB and/or of the element vanadium, based on the respective element; and a total amount of less than 20 ppm of said water-soluble compounds is present, based on the aforementioned elements.

13. The method according to claim 1, wherein the aqueous composition of the step b) reaction rinse contains less than 50 ppm of water-soluble compounds of the elements Co, Ni, Cu and/or Sn, based on the respective element; and a total amount of less than 50 ppm of the water-soluble compounds of Co, Ni, Cu and Sn, based on said element, is present.

14. The method according to claim 1, wherein no rinse step is performed between the conversion treatment and the reaction rinse.

15. The method according to claim 1, wherein the water-soluble compounds of the elements zirconium and/or titanium in the acidic aqueous composition for the conversion treatment of step a) are selected from the group consisting of zirconium fluoroacids, titanium fluoroacids, salts of zirconium fluoroacids, salts of titanium fluoroacids and combinations thereof.

16. The method according to claim 1, wherein the acidic aqueous composition for the conversion treatment of step a) contains a total of less than 0.1 g/kg of phosphates dissolved in water, calculated as $PO_4$.

17. The method according to claim 16, wherein the conversion treatment of step a) does not create a phosphate layer with a layer density of at least 0.2 $g/m^2$, based on $PO_4$.

18. The method according to claim 1, wherein the acidic aqueous composition for the conversion treatment of step a) contains less than 0.005 g/L silanes, calculated based on the respective silanols.

19. The method according to claim 1, wherein no drying step is performed after the step b) reaction rinse and before the electro-dip coating.

20. The method according to claim 1, wherein the metal component comprises surfaces of steel and/or galvanized steel at least in part.

* * * * *